US006613390B2

(12) United States Patent
Jaworowski et al.

(10) Patent No.: US 6,613,390 B2
(45) Date of Patent: Sep. 2, 2003

(54) COMPOUND, NON-CHROMIUM CONVERSION COATINGS FOR ALUMINUM ALLOYS

(75) Inventors: Mark R. Jaworowski, Glastonbury, CT (US); Michael A. Kryzman, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 153 days.

(21) Appl. No.: 09/741,470

(22) Filed: Dec. 19, 2000

(65) Prior Publication Data

US 2002/0110642 A1 Aug. 15, 2002

(51) Int. Cl.[7] ..... B05D 1/36
(52) U.S. Cl. ..... 427/409; 148/248; 148/275
(58) Field of Search ..... 148/240, 243, 148/248, 275; 427/409

(56) References Cited

U.S. PATENT DOCUMENTS

| | | | | |
|---|---|---|---|---|
| 3,066,055 A | * | 11/1962 | Pimbley | 148/268 |
| 3,849,264 A | * | 11/1974 | Weber et al. | 205/229 |
| 4,119,763 A | | 10/1978 | Blair | |
| 4,711,667 A | * | 12/1987 | Bibber | 106/14.21 |
| 5,192,374 A | * | 3/1993 | Kindler | 148/272 |
| 5,192,447 A | | 3/1993 | Fivizzani | |
| 5,194,138 A | * | 3/1993 | Mansfeld et al. | 148/241 |
| 5,244,956 A | | 9/1993 | Miller | |
| 5,266,611 A | | 11/1993 | Teschendorf | |
| 5,322,560 A | * | 6/1994 | DePue et al. | 106/14.21 |
| 5,520,750 A | | 5/1996 | Riley | |
| 5,582,654 A | * | 12/1996 | Mansfeld et al. | 148/273 |
| 5,866,652 A | | 2/1999 | Hager et al. | |
| 6,077,885 A | | 6/2000 | Hager et al. | |
| 6,248,184 B1 | | 6/2001 | Dull et al. | |
| 6,287,394 B1 | | 9/2001 | Buxton et al. | |
| 6,312,812 B1 | | 11/2001 | Hauser et al. | |
| 6,315,823 B1 | | 11/2001 | Dolan | |

FOREIGN PATENT DOCUMENTS

| | | | |
|---|---|---|---|
| CA | 2057825 | * | 6/1992 |
| EP | 0 492 713 | | 7/1992 |
| EP | 0 640 668 | | 3/1995 |
| JP | 04-218681 | * | 8/1992 |
| JP | 8-176891 | | 7/1996 |
| JP | 9-268264 | | 10/1997 |
| SU | 1120233 | | 10/1984 |
| WO | WO 96/15292 | * | 5/1996 |
| WO | WO 00/36176 | | 6/2000 |
| WO | WO 01/86016 | | 11/2001 |

OTHER PUBLICATIONS

Mansfeld et al, Report of Gov. Rep. Announce, Index 95(20), 1995.*

Mansfeld et al, Mat. Sci. + Eng. A, 198(1–2), pp. 51–61, 1995.*

Aldykewicz et al, J. Electrochem. Soc., 142(10), pp. 3342–3350, 1995.*

Morita et al, J. of Japan Institute of Light Metals, 50(11), pp. 560–566, 2000.*

Kengo et al, Jidosha Gijui Sukai Gak. Koenkai Maez. 96–00, pp. 6–8, 2000.*

Mansfeld et al, J. Electrochem. Soc., 138(12), pp. L74–L75, 1991.*

Mansfeld et al, Electrochim. Acta., 37(12), pp. 2277–82, 1992.*

Mansfeld et al, Mater. Sci. Forum, 111–112, pp. 191–200, 1992.*

Mansfeld et al, br. corros. J., 29(3), pp. 194–200, 1994.*

* cited by examiner

*Primary Examiner*—Erma Cameron
(74) *Attorney, Agent, or Firm*—Bachman & LaPointe, P.C.

(57) ABSTRACT

The present invention relates to a compound, non-chromium conversion coating for a part formed from an aluminum alloy. The coating is formed by providing a first solution containing an anodic inhibitor species, providing a second solution containing a cathodic corrosion inhibitor species, and immersing the part to be coated in a first one of the first and second solutions and thereafter in a second one of the first and second solutions. Suitable anodic inhibitor species include tungstates, permanganates, vanadates, molybdates, and mixtures thereof. Suitable cathodic corrosion inhibitors include cobalt, cerium, other lanthanide elements, and mixtures thereof. In one embodiment, the conversion coating is formed using a cerium containing solution and a tungstate containing solution.

9 Claims, No Drawings

COMPOUND, NON-CHROMIUM CONVERSION COATINGS FOR ALUMINUM ALLOYS

BACKGROUND OF THE INVENTION

The present invention relates to a method for forming a compound, non-chromium conversion coating on a part formed from an aluminum alloy.

Chromate conversion coatings are used to protect parts manufactured from aluminum alloys from corrosion. These coatings are formed by treating the aluminum surface of the part with solutions containing hexavalent chromium. Hexavalent chromium is an International Agency for Research on Cancer (IARC) Group 1 or proven human carcinogen. Thus, such coatings are to be avoided where possible.

SUMMARY OF THE INVENTION

Accordingly, it is an object of the present invention to provide a compound, non-chromium conversion coating for use with aluminum alloy parts.

It is a further object of the present invention to provide a method for depositing a non-chromium containing on a part formed from an aluminum alloy.

In accordance with the present invention, a compound, non-chromium conversion coating may be applied to a part formed from an aluminum alloy by immersing the part into a solution containing an anodic inhibitor followed by immersion of the part into a solution containing a cathodic corrosion inhibitor. Anodic inhibitors precipitate under acidic, reducing conditions and ideally undergo a valence change to a reduced state. Examples of anodic inhibitors which may be used to form the coatings of the present invention include tungstate, permanganate, vanadate, and molybdate species and mixtures thereof. Cathodic inhibitors precipitate under alkaline reducing conditions and ideally undergo a change in valence state. Examples of cathodic inhibitors include cobalt, cerium, other lanthanide elements such as praseodymium, and mixtures thereof.

In one embodiment of the present invention, the cathodic corrosion inhibitor comprises from about 10 g/L to about 30 g/L cerium (III) nitrate in deionized water and the anodic inhibitor solution is a solution comprising 10 g/L tungstic acid in ammonium hydroxide.

A compound non-chromium conversion coating in accordance with the present invention comprises $Ce_2(WO_4)_3$ having a thickness in the range of about 0.96 $\mu$m to about 1.51 $\mu$m.

Other details of the compound, non-chromium conversion coating of the present invention, as well as other objects and advantages attendant thereto, are set forth in the following detailed description.

DETAILED DESCRIPTION OF THE PREFERRED EMBODIMENT(S)

The present invention relates to conversion coatings based on sequential deposition of anodic and cathodic corrosion inhibiting compounds on a part formed from an aluminum alloy, such as aluminum alloy 6061 which consists essentially of 1.0 wt. % magnesium, 0.25 wt. % copper, 0.6 wt. % silicon, 0.25 wt. % chromium and the balance aluminum and inevitable impurities, through an immersion process. It has been found that the coating weights achieved by the process of the present invention are comparable to those achieved by a chromate conversion coating process. The coating weights are in the range of from about 400–800 mg/sq. ft.

Prior to having a coating in accordance with the present invention applied to it, the surface or the surfaces of the aluminum alloy part to be coated are sanded using a 200–400 grit paper. After sanding, the surface(s) to be coated are washed in a mild detergent and rinsed sequentially with tap water, deionized water and ethanol.

After the part has been abrasively cleaned, washed and rinsed, it is first immersed into a solution containing an anodic inhibitor species at room temperature without any agitation. The anodic inhibitor species may be selected from the group consisting of tungstates, permanganates, vanadates, molybdates, and mixtures thereof. A suitable solution which may be used is one which contains from about 10 g/L to about 20 g/L tungstic acid in ammonium hydroxide and which has a pH in the range of from about 11 to about 12. For example, a useful solution is one which contains 10 g/L tungstic acid in ammonium hydroxide and a pH of 11.82. The aluminum alloy part is preferably immersed in the solution containing the anodic inhibitor for a time in the range of from about 3 minutes to 15 minutes. Other useful solutions would be solutions containing the anodic inhibitor species in the range of from about 1.0 to about 100 g/L.

Following immersion in the solution containing the anodic inhibitor species, the aluminum alloy part is immersed in a solution containing a cathodic corrosion inhibitor species. Here again, the part is immersed in the solution at room temperature without any agitation. Suitable solutions which may be used include cobalt, cerium, other lanthanide elements, such as praseodymium, and mixtures thereof. Solutions containing from about 10 g/L to about 50 g/L, preferably from about 10 g/L to about 30 g/L, cerium (III) nitrate in deionized water having a pH in the range of from about 3.5 to about 3.6 may be used. The aluminum alloy part is immersed in the cathodic inhibitor solution for a time period in the range of from about 3 minutes to about 15 minutes. Other solutions containing other cathodic corrosion species would also have from about 10 g/L to about 50 g/L of the cathodic corrosion species and immersion times during their use would be the same as above.

It has been found that aluminum alloy 6061 parts treated in accordance with the present invention show a 10× improvement in barrier properties and spontaneous corrosion rates over untreated aluminum alloy 6061.

To demonstrate the method of the present invention, the following example was performed.

EXAMPLE

Conversion coatings were applied to 6061 aluminum test coupons using three solutions. The solutions were:

Solution #1: 10 g/L Cerium (III) Nitrate in Deionized Water, pH=3.60;

Solution #2: 30 g/L Cerium (III) Nitrate in Deionized Water, pH=3.5; and

Solution #3: 10 g/L Tungstic Acid in Ammonium Hydroxide, pH=11.82

The test coupons were sanded using 220 and 400 grit paper, washed with a mild detergent, and rinsed with tap water, deionized water, and ethanol. The samples were all dipped at room temperature with no agitation using three different methods. The methods are described in the following table.

| Method | #1<br>1st Dip: Solution #3 (3 min.)<br>2nd Dip: Solution #1 (3 min.) | #2<br>1st Dip: Solution #3 (15 min.)<br>2nd Dip: Solution #1 (15 min.) | #3<br>1st Dip: Solution #2 (3 min.)<br>2nd Dip: Solution #3 (3 min.) |
|---|---|---|---|
| Peak Height of Ce | 103 counts | 82 counts | 137 counts |
| Coverage of Ce | 92 mg/ft$^2$ | 73 mg/ft$^2$ | 122 mg/ft$^2$ |
| Peak Height of W | 192 counts | 174 counts | 262 counts |
| Coverage of W | 232 mg/ft$^2$ | 211 mg/ft$^2$ | 317 mg/ft$^2$ |
| Thickness of $Ce_2(WO_4)_3$ | 1.12 $\mu$m | 0.96 $\mu$m | 1.51 $\mu$m |

An x-ray fluorescence spectrometer was used to confirm aluminum alloy part and to estimate the coating weight. Typical coating compositions determined by this method are listed above.

The quality of the conversion coatings was evaluated using electrochemical impedance spectroscopy. The impedance spectra for the coatings shown above confirms that the coatings provide corrosion protection and that best results are obtained by treating first with the anodic inhibiting species (tungstate) and then with the cathodic inhibiting species (cerium). If desired however, the aluminum alloy part could first be immersed in the solution containing the cathodic inhibiting species and then into the solution containing the anodic inhibiting species.

Coatings formed in accordance with one embodiment of the present invention comprise $Ce_2(WO_4)_3$ having a thickness in the range of from about 0.96 $\mu$m to about 1.51 $\mu$m.

It is apparent that there has been provided in accordance with the present invention a compound, non-chromium conversion coating for aluminum alloys which fully satisfies the objects, means, and advantages set forth hereinbefore. While the present invention has been described in the context of specific embodiments thereof, other alternatives, modifications, and variations will become apparent to those skilled in the art having read the foregoing description. Therefore, it is intended to embrace those alternatives, modifications, and variations as fall within the broad scope of the appended claims.

What is claimed is:

1. A method for forming a non-chromium conversion coating on an aluminum alloy part comprising the steps of:

providing a first solution containing an anodic corrosion inhibitor species selected from the group consisting of tungstates, permanganates, vanadates, molybdates, and mixtures thereof;

providing a second solution containing a cathodic corrosion inhibitor species selected from the group consisting of cobalt, cerium, and lathanide elements, and mixtures thereof; and immersing said aluminum alloy part in a first one of said first and second solutions and thereafter in a second one of said first and second solutions wherein both said first and second solution are maintained at room temperature.

2. A method according to claim 1, wherein said first solution providing step comprises providing a solution containing an anodic corrosion inhibitor species selected from the group consisting of tungstates, permanganates, vanadates, molybdates, and mixtures thereof at a concentration in the range of from about 10 g/L to about 20 g/L.

3. A method according to claim 1, wherein said second solution providing step comprises providing a solution containing a cathodic corrosion inhibitor species selected from the group consisting of cobalt, cerium, and lathanide elements, and mixtures thereof at a concentration in the range of from about 10 g/L to about 50 g/L.

4. A method according to claim 1, wherein said immersing step comprises immersing said aluminum alloy part in said first solution and thereafter into said second solution.

5. A method according to claim 1, wherein said immersing step comprises immersing said aluminum alloy part in said second solution and thereafter into said first solution.

6. A method according to claim 1, wherein said second solution providing step comprises providing a solution having a pH in the range of from about 3.5 to about 3.6 and containing from about 10 g/L to about 50 g/L cerium (III) nitrate in deionized water and said aluminum alloy part is immersed in said second solution for a time period in the range of from about 3 minutes to about 15 minutes.

7. A method according to claim 1, further comprising abrasively treating at least one surface of aid aluminum alloy part to be coated, washing said at least one surface with a detergent, and rinsing said at least one surface prior to immersing said aluminum alloy part in said first one of said first and second solutions.

8. A method according to claim 7, wherein said rinsing step comprises rinsing said at least one surface sequentially in tap water, deionized water and ethanol.

9. A method for forming a non-chromium conversion coating on an aluminum alloy part comprising the steps of:

providing a first solution containing an anodic inhibitor species;

providing a second solution containing a cathodic corrosion inhibitor species;

immersing said aluminum alloy part in a first one of said first and second solutions and thereafter in a second one of said first and second solutions; and wherein said second solution providing step comprises providing a solution containing a cathodic corrosion inhibitor species selected from the group consisting of cobalt, cerium, lathanide elements, and mixtures thereof at a concentration in the range of from about 10 g/L to about 50 g/L wherein said first solution providing step comprises providing a solution having a pH in the range of from about 11 to 12 and containing from about 10 g/L to about 20 g/L tungstic acid in ammonium hydroxide and wherein said aluminum alloy part is immersed in said first solution for a time period in the range of from about 3 minutes to about 15 minutes.

* * * * *